US006173654B1

(12) United States Patent
Ngai

(10) Patent No.: US 6,173,654 B1
(45) Date of Patent: Jan. 16, 2001

(54) TOY RACING CAR TRACK SYSTEM

(75) Inventor: Kam Fai Ngai, Shatin (HK)

(73) Assignee: Artin Industrial Co., Ltd., Kowloon (HK)

( * ) Notice: Under 35 U.S.C. 154(b), the term of this patent shall be extended for 0 days.

(21) Appl. No.: 09/302,368

(22) Filed: Apr. 30, 1999

(51) Int. Cl.[7] ..... B60L 15/00
(52) U.S. Cl. ..... 104/295; 104/53; 104/60
(58) Field of Search ..... 104/295, 60, 88.04, 104/288, 244, 53, 54, 67; 446/444

(56) References Cited

U.S. PATENT DOCUMENTS 3,858,875 * 1/1975 Nemeth et al. ..... 104/54
4,355,807 * 10/1982 Prehodka ..... 104/60
5,174,569 * 12/1992 Ngai ..... 104/60
5,452,893 * 9/1995 Faulk et al. ..... 446/444
5,542,668 * 8/1996 Casale et al. ..... 104/60
5,775,227 * 7/1998 Mullen ..... 104/88.04

* cited by examiner

*Primary Examiner*—S. Joseph Morano
*Assistant Examiner*—Lois A. Olson
(74) *Attorney, Agent, or Firm*—Leydig, Voit & Mayer, Ltd.

(57) ABSTRACT

A toy racing car track system includes track sections with electrical power supply rails and connected end-to-end to form at least one lane for an electric toy car. The lane includes a gap having front and rear ends and a carriage supported for movement across the gap to convey the car across the gap under the momentum of the car and subsequently returning upon the car leaving the carriage. A retainer on the carriage retains the car in transit. A resetter resets the retainer. The gap is inclined at a small angle upwards in order for the carriage to return to by gravitational force.

16 Claims, 10 Drawing Sheets

20
340
32
344
364
30
362
360
366
226
330
342
300
310
312
320
330
220
232
230
200
212
210
100
10
10
222
226
224
40
50
341
350
366
360
340
226

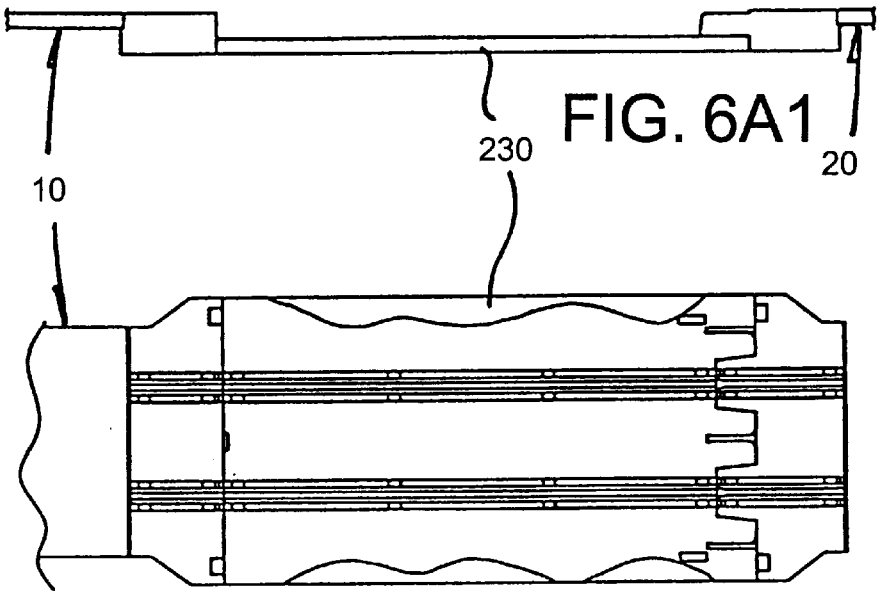
FIG. 6A1
FIG. 6A2
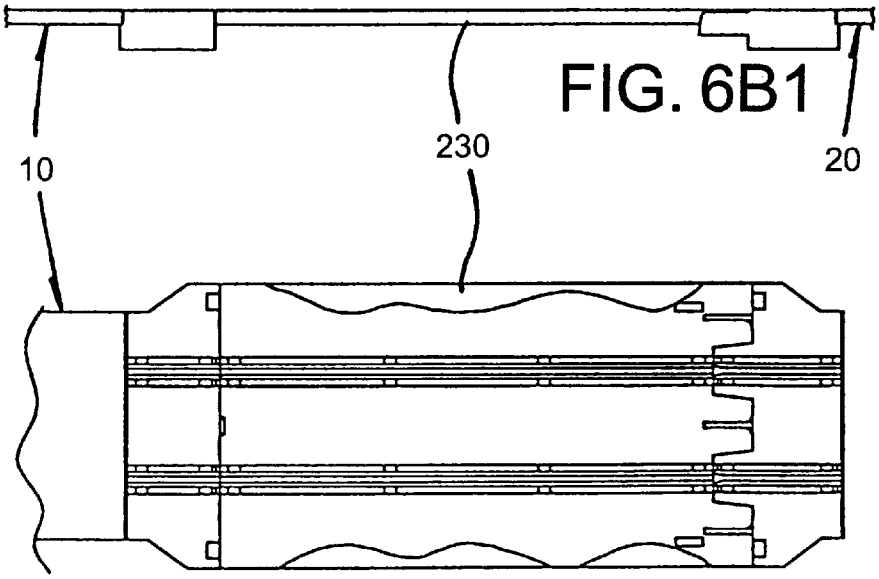
FIG. 6B1
FIG. 6B2

20'
26'
22'
24'
200'
232'
302'
30'
300'
10'
100'

30'
342'

340'
34'

20'
26'
200'
300'
30'
100'
10'

20'
100'
22'
30'
300'
200'
232'
10'

302'
22'
340'
24'
342'
34'

26'
30'

20'
100'
26'
30'
300'
200'
10'

20'
30'
100'
300'
200'
232'
10'

30'
34'
26'
22'
24'
302'
340'
342'

30'

20'
100'
30'
300'
200'
10'

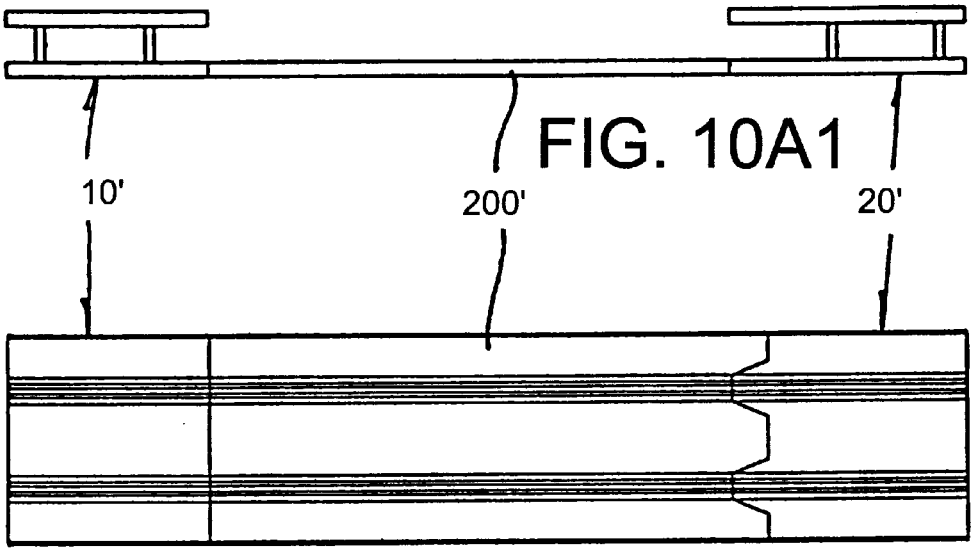
FIG. 10A1
FIG. 10A2
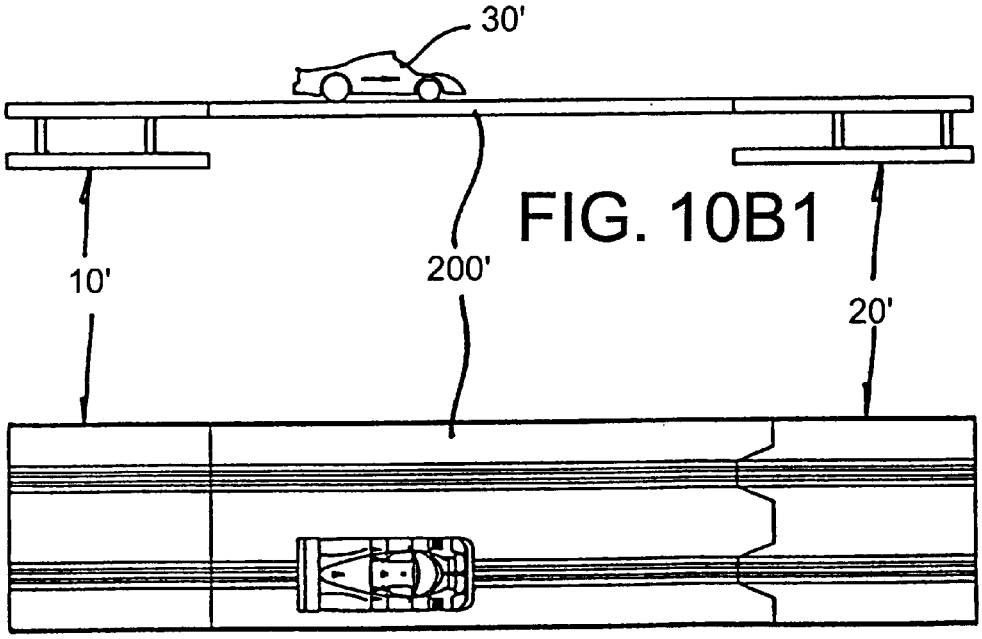
FIG. 10B1
FIG. 10B2

TOY RACING CAR TRACK SYSTEM

BACKGROUND OF THE INVENTION

In a conventional construction, an electric toy racing car track system is formed by a series of track sections which are connected end-to-end together to form two lanes for respective toy cars to run along. Each lane is provided with a pair of power supply rails for supplying electrical power to and a central groove for guiding the respective car to run. The power supply rails are essentially continuous, except briefly at certain lane crossing and/or changing junctions, such that the cars are to be power driven and running by themselves practically at all time, which is found to be uninteresting or unexciting.

The subject invention seeks to provide a toy racing car track system which is more fun to play with and/or offers a change in the manner the cars travel.

SUMMARY OF THE INVENTION

According to the invention, there is provided a toy racing car track system which comprises a plurality of track sections including electrical power supply rails and connected end-to-end together to form at least one lane for an electric toy car to run therealong, wherein the lane includes a portion having front and rear ends and a carriage supported for movement across the portion in order to convey the car from the front portion end to the rear portion end under the action of momentum of the car and subsequently to self return to the front portion end upon the car leaving the carriage.

Preferably, the portion is in the form of a gap having opposite sides corresponding to the front and rear portion ends and a bottom surface at a level relatively lower than that of the upper surfaces of the adjoining track sections.

In a first preferred embodiment, the gap is provided by a track section having front and rear platforms at opposite ends, said platforms having respective upper surfaces at the same level as that of and being for connection to the adjoining track sections.

More preferably, the platforms also include electrical power supply rails.

It is further preferred that the rear platform has a part including the power supply rails and protruding into the gap, and the carriage has a front end recess for accommodating the said part in order for the car conveyed thereon to regain electrical power when the carriage reaches the rear gap side.

In a second preferred embodiment, the portion is in the form of a gap provided by a track section having opposite ends corresponding to the front and rear portion ends, said track section being positioned to have an upper surface at a level relatively lower than that of the upper surfaces of the adjoining track sections.

More preferably, the adjoining track section at the rear end of the track section providing the gap has a part including the power supply rails and protruding into the gap, and the carriage has a front end recess for accommodating the said part in order for the car conveyed thereon to regain electrical power when the carriage reaches the rear gap side.

It is preferred that the carriage includes a retainer for retaining the car on the carriage in transit.

More preferably, the retainer is movable between a first position for retaining the car and a second position for releasing the car when the carriage reaches the rear gap side.

In a first specific construction, the retainer is in the form of an inverted U-shaped frame having two limbs hinged to opposite sides of the carriage for pivotal movement between a lower position and an upright position corresponding to the said first and second positions.

In a second specific construction, the retainer is provided below the upper surface of the carriage for movement between an upper position and a lower position corresponding to the said first and second positions, and is spring-loaded towards the upper position for retaining the car by a bottom guide pin of the car.

Preferably, an abutment is provided at the rear gap side for hitting by the retainer when the carriage reaches there, whereby the retainer is moved from the first position to the second position.

It is preferred that a resetter is provided for moving the retainer from the second position to the first position after the car has left the carriage.

More preferably, the resetter is provided on the carriage and is movable from a ready position to an operating position for moving the retainer to the said first position.

Further more preferably, the resetter has a rear part which extends beyond the back of the carriage when the resetter is in the ready position, for hitting the rear gap side when the carriage returns there, whereby the resetter is moved to the said operating position.

In a preferred arrangement, the portion or gap is inclined at a small angle upwards to have its rear end or side relatively higher than its front end or side in order for the carriage to self return to the said front end or side under the action of gravity.

BRIEF DESCRIPTION OF DRAWINGS

The invention will now be more particularly described, by way of example only, with reference to the accompanying drawings, in which.

Figures 1A, 1B:
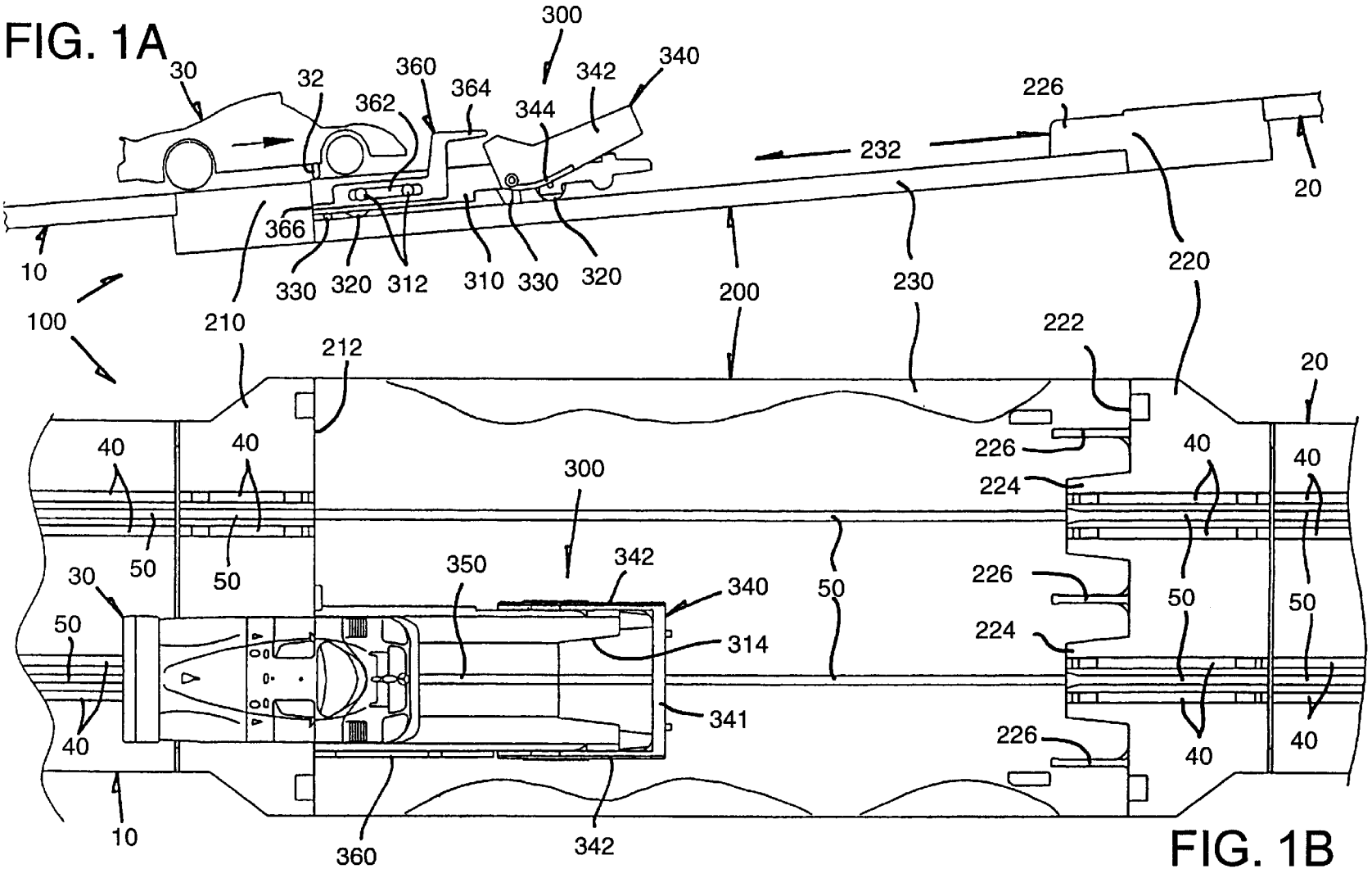
FIG. 1A is a right side view and FIG. 1B a top plan view of a part of a first embodiment of a toy racing car track system, including a carriage, in accordance with the invention and a toy car running along it, showing the car and carriage in an initial operating condition.
Figures 2A, 2B:
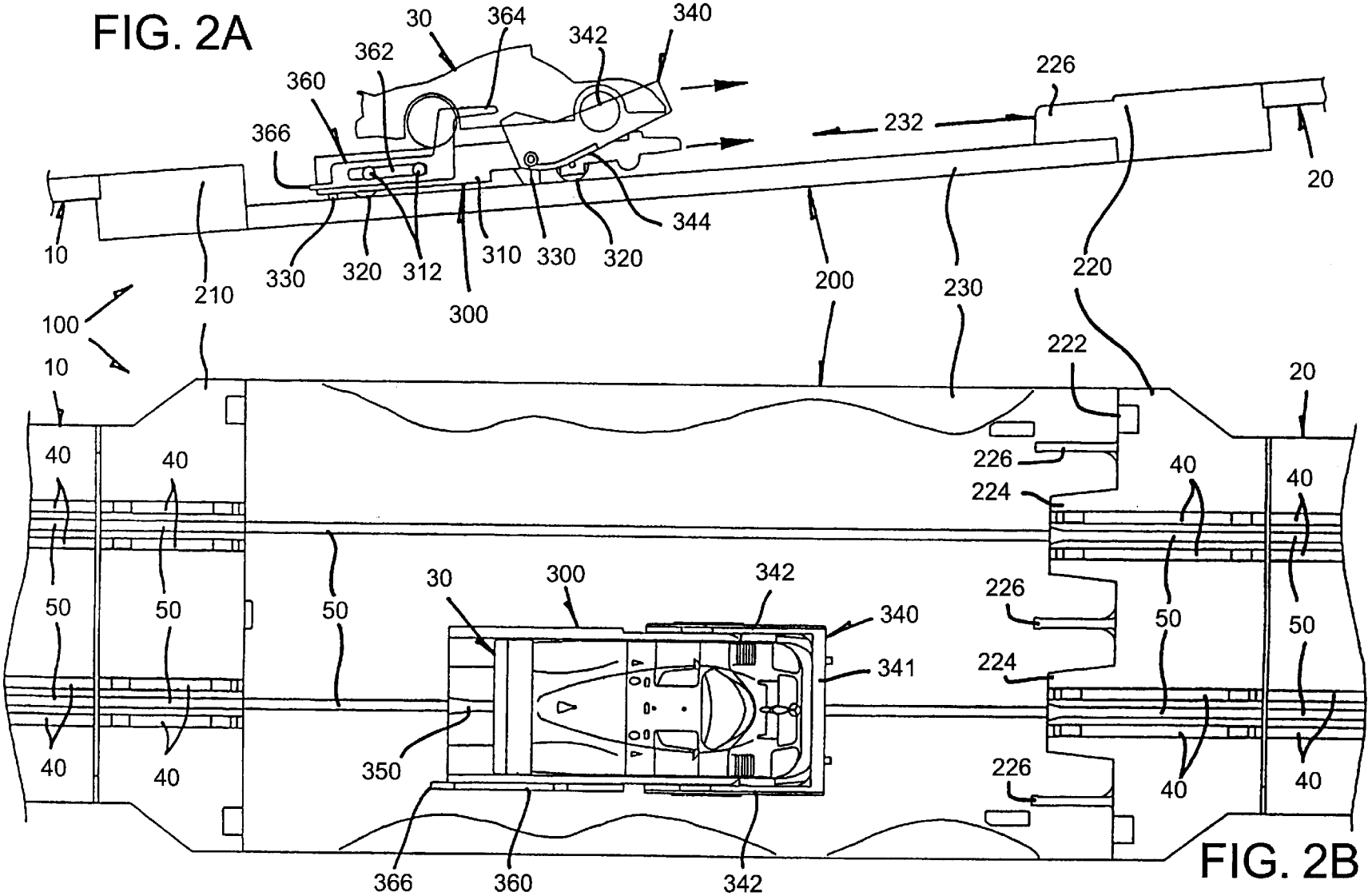
Figures 3A, 3B:
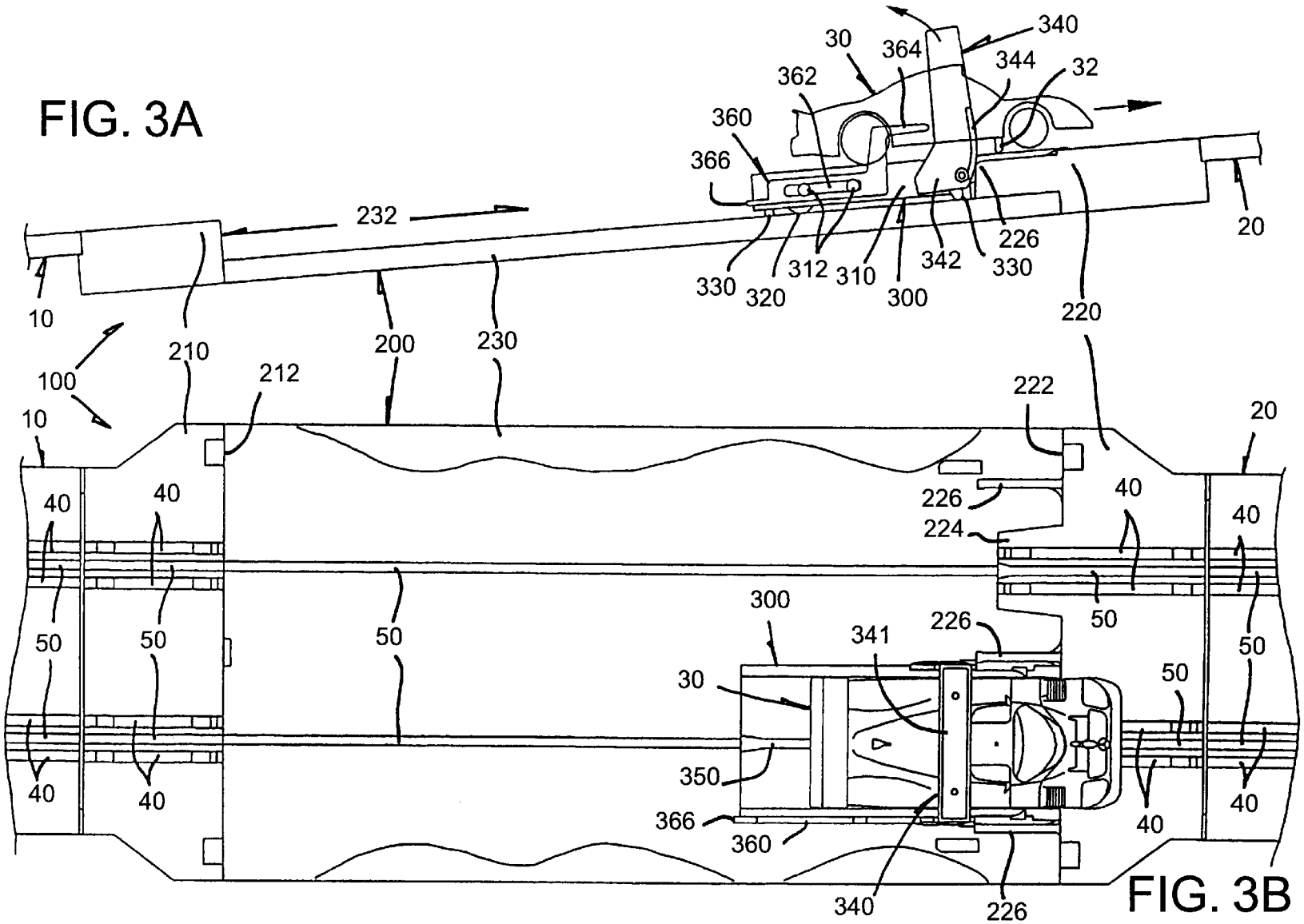
Figures 4A, 4B:
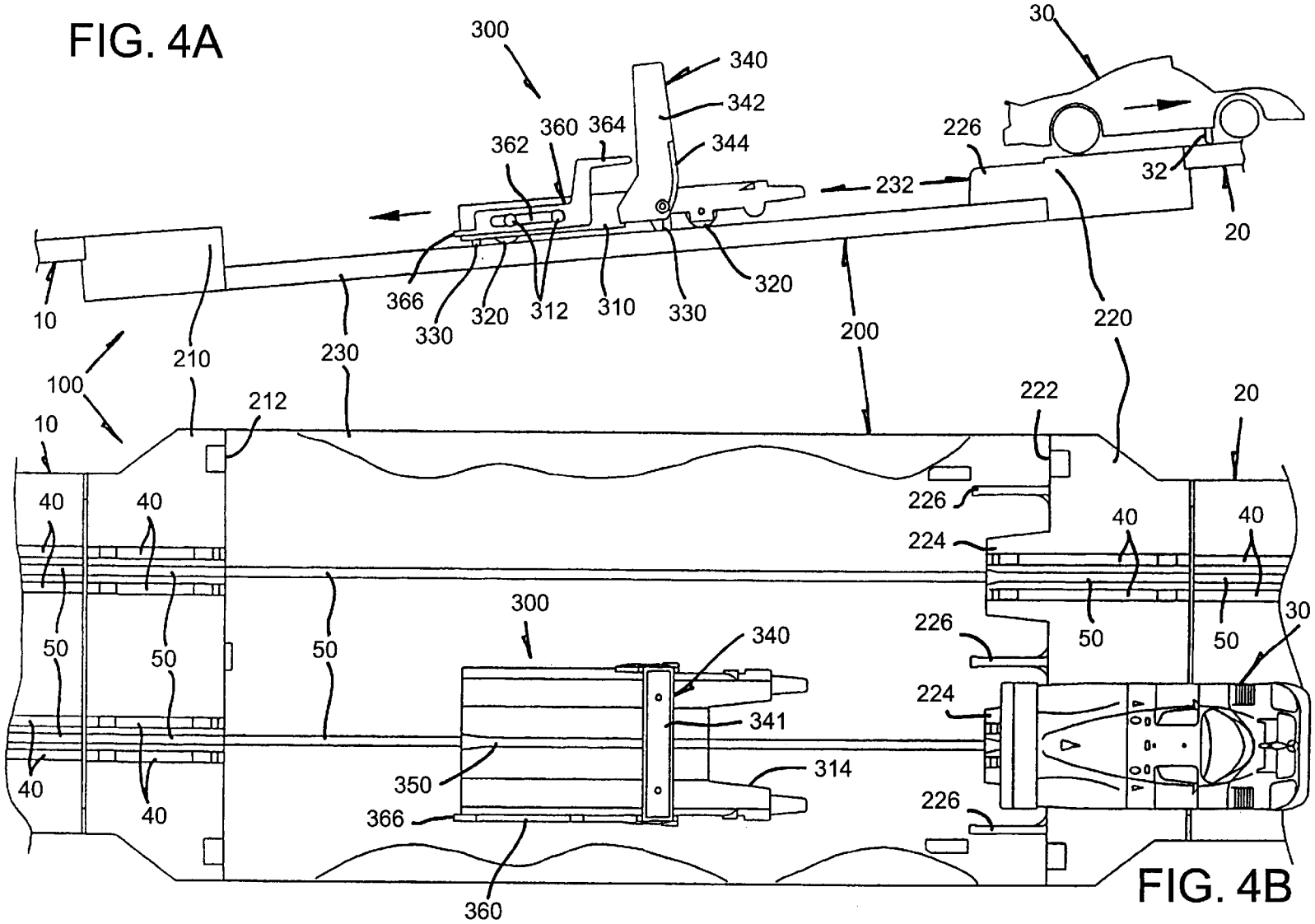
Figure 5:
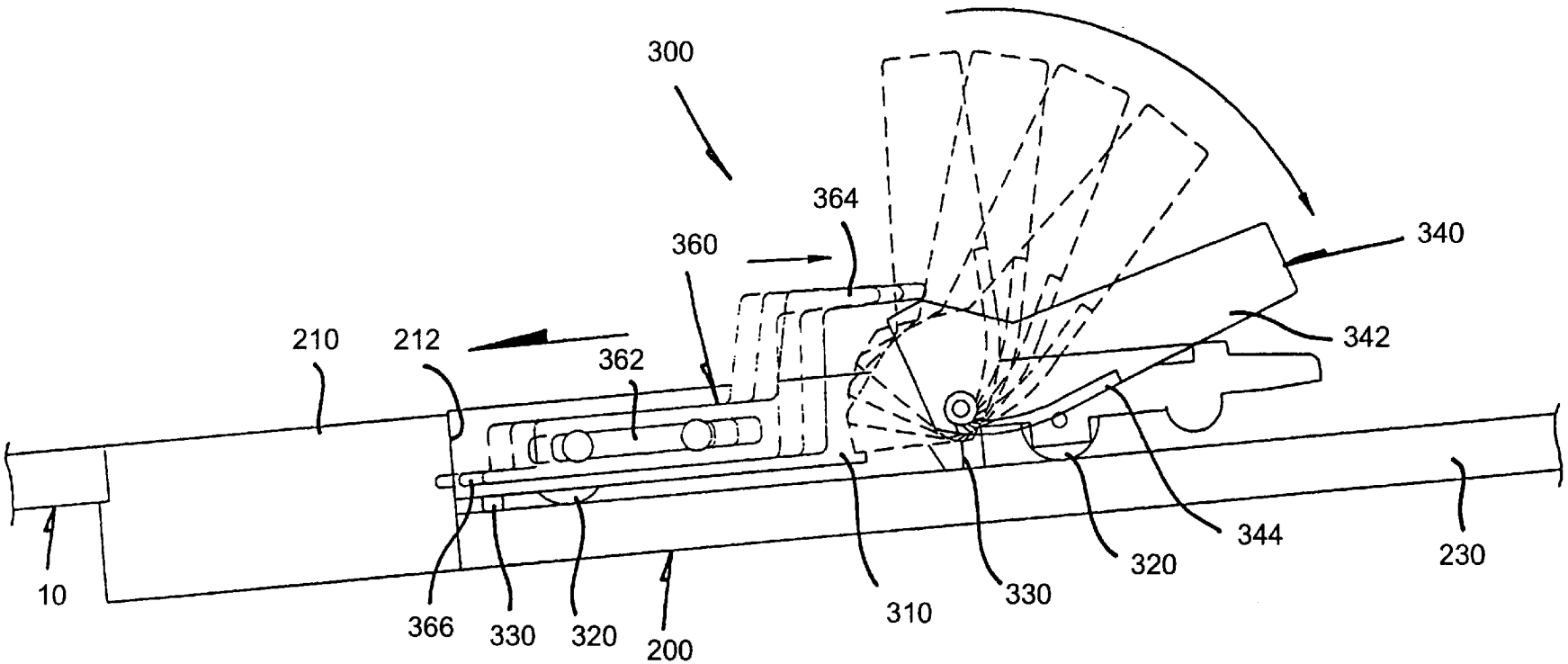
Figures 7A, 7B, 7C, 7D:
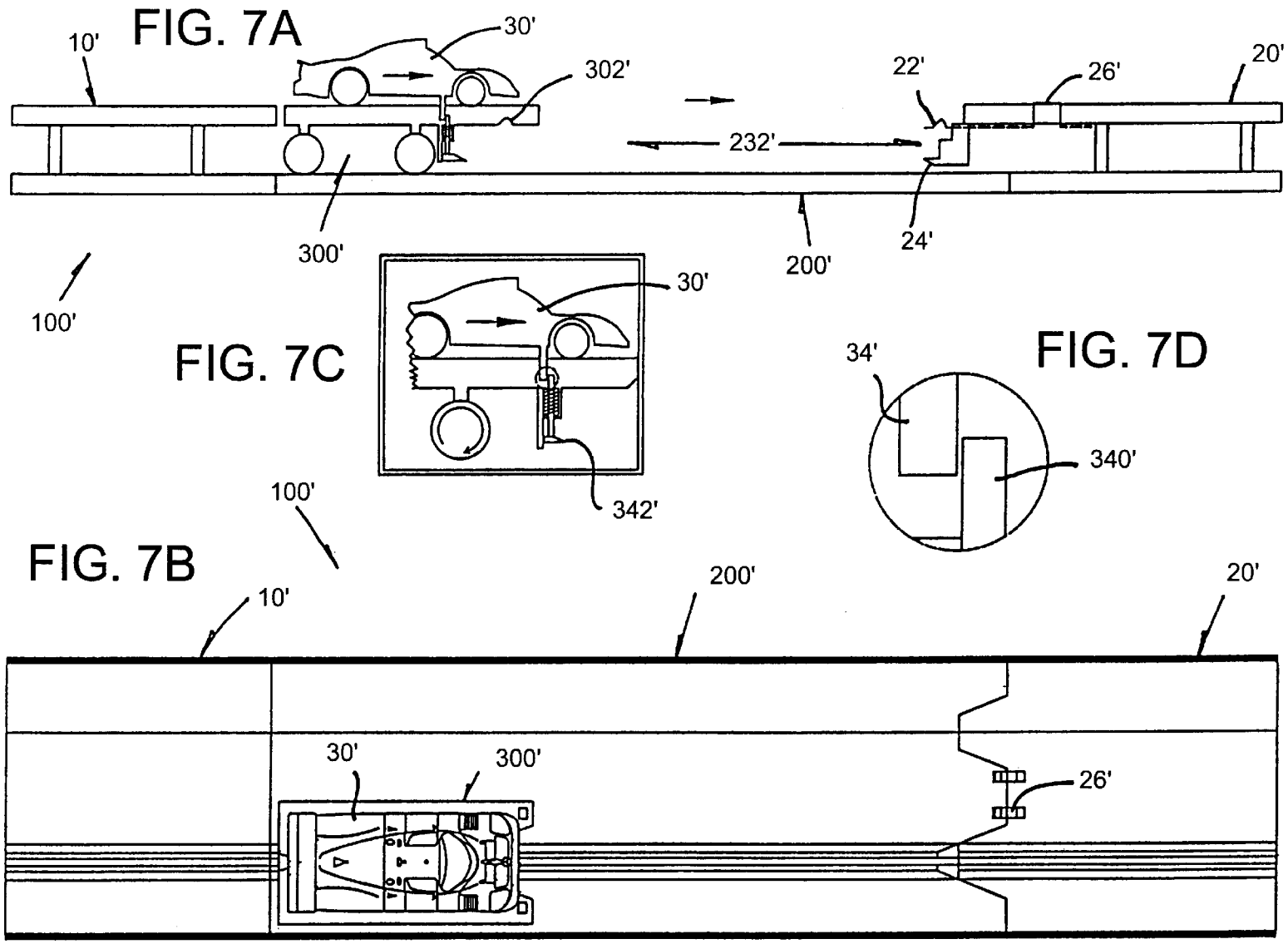
Figures 8A, 8B, 8C, 8D:
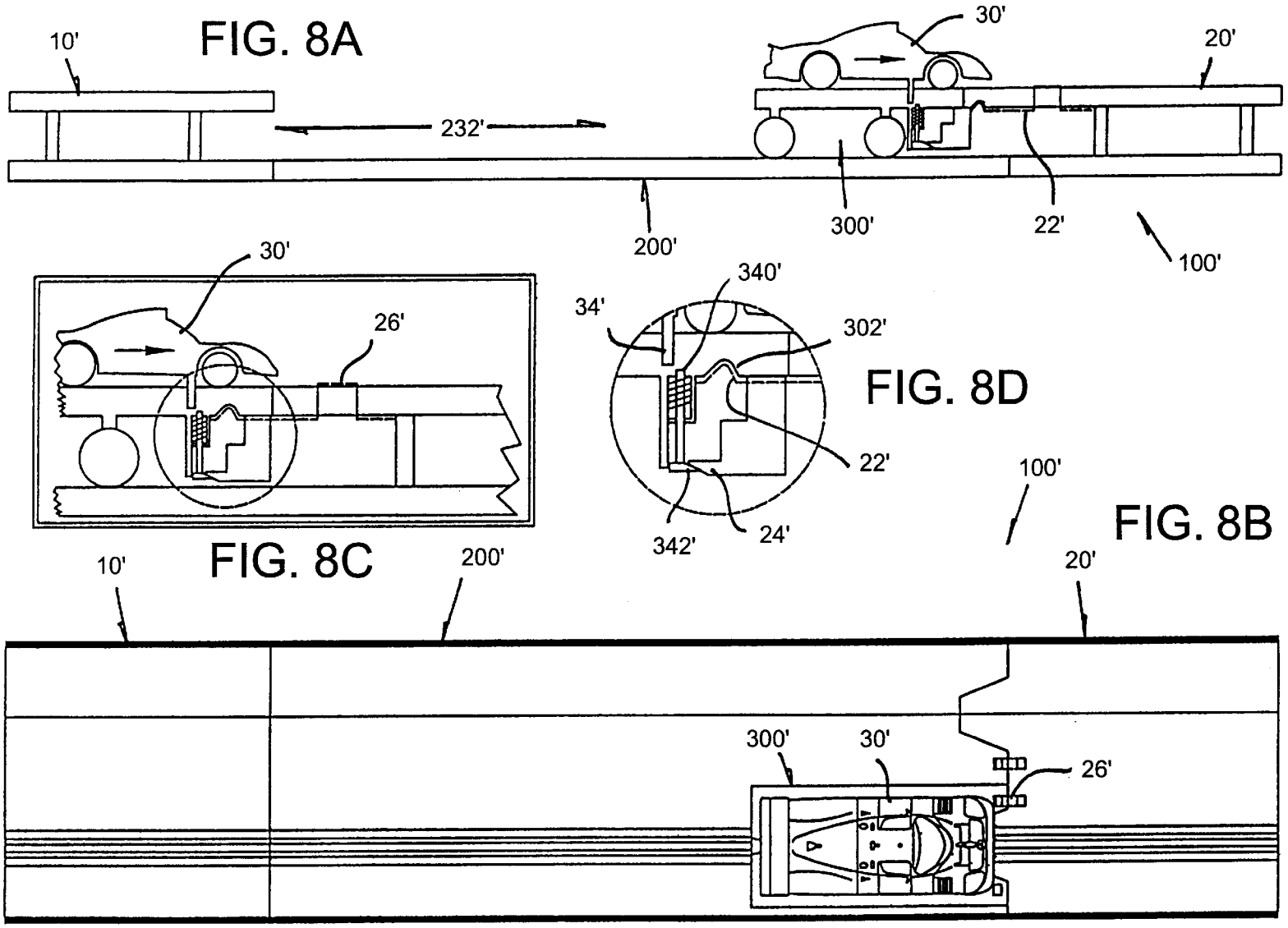
Figures 9A, 9B, 9C, 9D:
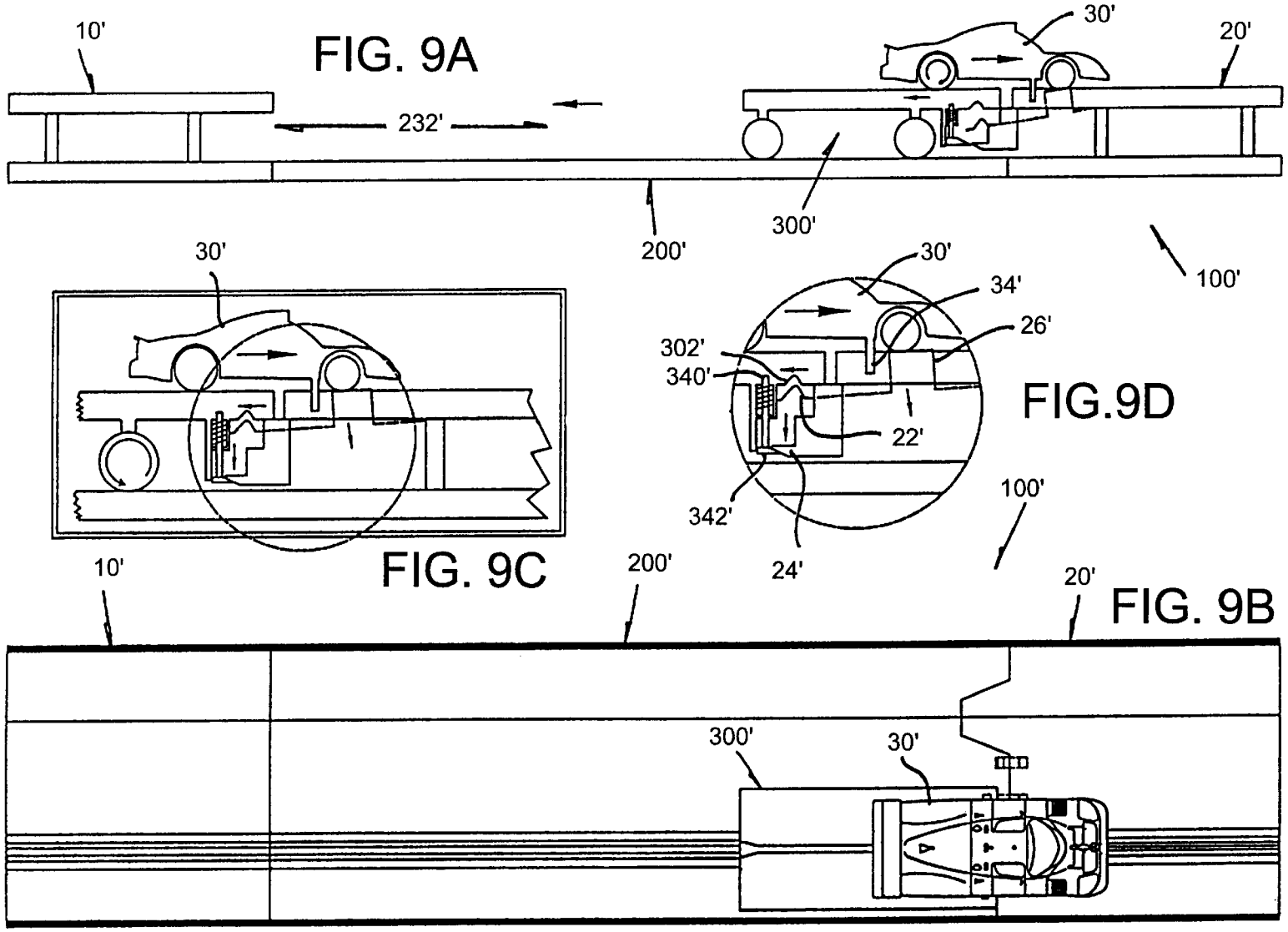

Each of FIGS. 2A and 2B, FIGS. 3A and 3B, and FIGS. 4A and 4B correspond to FIGS. 1A and 1B, showing the car and carriage in sequential subsequent operating conditions;

FIG. 5 is a right side view of the carriage of FIGS. 4A and 4B, showing how the carriage returns to the operating condition of FIGS. 1A and 1B;

FIGS. 6A1 and 6A2 and FIGS. 6B1 and 6B2 are pairs of right side and top plan views showing the part of the toy racing car track system of FIGS. 1A and 1B in alternative arrangements;

FIG. 7 is a right side view, FIG. 7B is a top plan view of a part of a second embodiment of a toy racing car track system, including a carriage, in accordance with the invention and a toy car running along it, showing the car and carriage in an initial operating condition FIG. 7C is an enlarged view of the carriage, and FIG. 7D is a detail view of part of FIG. 7C.;

FIGS. 8A, 8B, 8C, and 8D and FIGS. 9A, 9B, 9C, and 9D correspond to FIG. 7, showing the car and carriage in sequential subsequent operating conditions; and FIGS. 10A1 and 10A2 and FIGS. 10B1 and 10B2 are pairs of right side and top plan views showing the part of the toy racing car track system of FIGS. 7A and 7B in alternative arrangements.

DETAILED DESCRIPTION OF PREFERRED EMBODIMENT

Referring initially to FIGS. 1A to 5 of the drawings, there is shown a first toy racing car track system 100 embodying the invention, which track system 100 is typically formed by a plurality of track sections connected end-to-end together to form an endless loop, including two conventional track sections 10 and 20 and a novel straight intermediate track section 200. The track system 100 provides a pair of co-extending lanes for two racing toy cars 30, such as a standard car 30 as shown, to race with each other. The car 30 has a pair of power pick-up brushes 32 at the bottom of its front part. In general, each lane includes a pair of parallel power supply rails 40 for supplying electrical power to and a central groove 50 for guiding the car 30 by a bottom guide pin of the car 30 to run along the lane, as is already known in the art.

Referring to the track section 200, it has front and rear platforms 210 and 220 provided at opposite ends for match and connection with the adjoining track sections 10 and 20 at the same level and includes a main middle portion 230. The track portion 230 is made to be at a relatively lower level, thereby forming a wide gap 232 between the platforms 210 and 220 or the track sections 10 and 20. Opposite sides of the gap 232 coincide with confronting inner sides 212 and 222 of the respective platforms 210 and 220. Insofar as the platforms 210 and 220 are concerned, the usual power supply rails 40 and guiding grooves 50 exist. Likewise, but except at a lower level, the track portion 230 includes the two guiding grooves 50 and the associated power supply rails 40 (not shown for simplicity but see FIGS. 6A and 6B). The track system 100 includes two carriages 300, one for each lane, for free running back-and-forth across the track portion 230 between the opposite sides of the gap 232.

Each carriage 300 has a generally flat body 310 provided with four wheels 320 for movement along, and a pair of central front and rear bottom guide pins 330 for sliding engagement with the respective guiding groove 50 on the track portion 230. The body 310 is made such that, when the carriage 300 is on the track portion 230, its upper surface lies level with the upper surfaces of the platforms 210 and 220 and the adjoining track sections 10 and 20. The two guide pins 330 are provided along the central axis of the body 310, which ensure that the carriage 300 will maintain its orientation with respect to the guiding groove 50 underneath. The body 310 includes a groove 350 on the upper surface, which extends along the same central axis such that opposite ends of the groove 350 are in alignment with and may conjoin with the respective grooves 50 of the same lane on the platforms 210 and 220.

The carriage body 310 has a flat rear end and a front end formed with a central recess 314. The inner side 212 of the front platform 210 is straight across in order for the carriages 300 to park close. The inner side 222 of the rear platform 220 has a pair of entrance parts 224 which protrude into the gap 232. Each entrance part 224 includes, centrally, the respective power supply rails 40 and groove 50 on the platform 220. It also has a profile which is complementary to that of the front recess 314 of the respective carriage body 310 for close inter-fitting when the carriage 300 arrives.

Two abutments 226 are formed on opposite sides of each entrance part 224, which protrude from the inner side 222 of the rear platform 220 into the gap 232 and are aligned with opposite sides of the respective carriage 300.

Each carriage 300 includes a retainer 340 at the front end of the body 310 and a resetter 360 at the rear end. The retainer 340 is in the form of an inverted U-shaped frame which has a central cross bar 341 and includes two side limbs 342 hinged to opposite sides of the front end of the carriage body 310. The outer side of each limb 342 has a curved flange 344. The retainer 340 is pivotable between a lower position pointing forwards and an upright position, as best shown in FIG. 5.

The resetter 360 has a horizontal slot 362 and a forward pointing finger 364, and is slidably supported on the right side of the carriage body 310 by means of its slot 362 slidably engaging a pair of side pegs 312 on the body 310. The resetter 360 is slidable forwards for operation and backwards to become ready, and includes a tail end 366 which extends beyond the back of the carriage body 310 when the resetter 360 is in the rearmost position. While the retainer 340 is in the upright position, the resetter 360 is used, upon sliding fully forwards, by means of its finger 364 to topple the retainer 340 over and return it to the lower position, as illustrated in FIG. 5.

In use, the track section 200 is inclined at a small angle, of about 10° upwards with its rear platform 220 relatively higher than its front platform 210, with the adjoining track sections 10 and 20 inclined accordingly. Under the action of gravity, each carriage 300 parks against the front platform 210, with the retainer 340 staying normally in the lower position and the resetter 360 slid halfway forwards by reason of its tail end 366 being pushed inwards by inner side 212 of the platform 210.

Upon arrival, the car 30 will run onto the respective carriage 300, hence losing the electrical power previously supplied to it, and then be retained by the cross bar 341 of the retainer 340 (FIG. 1). The momentum of the car 30 will cause the carriage 300 to move uphill, while conveying the car 30 on it, along the track portion 230 (FIG. 2). As soon as the carriage 300 jerks off the front platform 210, the retainer 360 will slide fully backwards, by reaction, to have its tail end 366 re-extending beyond the back of the carriage body 310. Shortly before the carriage 300 finally reaches the rear platform 220, two events will occur.

First, the car 30 will re-pick up electrical power by its power pick-up brushes 32 coming again into contact with the power supply rails 40 on the entrance part 224 of the rear platform 220. Second, the retainer 340 will be pivoted to its upright position by reason of its flanges 344 hitting the respective abutments 226 (FIG. 3). As a result of these two events, given that the electrical power is now regained and the retainer cross bar 341 is now moved off the way, the car 30 will leave the carriage 300 and then continue to run in the usual manner (FIG. 4).

Upon unloading the car 30, the carriage 300 will lose all momentum and thus roll back downhill the track portion 230 under the action of its own weight, and eventually return to and park against the front platform 210. In transit, the retainer 340 will stay upright. When the carriage 300 parks in position, the resetter 360 will be jerked fully forwards by reason of its tail end 366 hitting the inner side 212 of the front platform 210. As a result of this, the resetter 360 will topple, by means of its finger 364, the retainer 340 over and down back to the lower position (FIG. 5), whereby the initial operating condition (as shown in FIGS. 1A and 1B, but without the car 30) is restored.

As illustrated in FIGS. 6A1, 6A2, 6B1, and 6B2, the middle track portion 230 may be relocated from the aforesaid lower position to an upper position level with the adjoining track sections 10 and 20 for normal car racing.

It is envisaged that the resetter 360 may be omitted and, instead, the retainer 340 may be returned from its upright position to its lower position by hitting a certain fixed abutment on its way back to the front platform 210, in a manner similar to that associated with the abutments 226.

Referring now to FIGS. 7A to 9D of the drawings, there is shown a second toy racing car track system 100' embodying the invention, which track system 100' is likewise formed by a plurality of track sections connected end-to-end together to form an endless loop, including two track sections 10' and 20', an intermediate track section 200' provided at a relatively lower level to form a gap 232' between the track sections 10' and 20', and a wheeled carriage 300' for running back-and-forth along the track section 200'. The carriage 300' is provided, at its front end, with a spring-loaded abutment 340' for engaging a bottom guide pin 34' of a racing toy car 30' upon arrival, thereby retaining the car 30' on the carriage 300'. The momentum of the car 30' will cause the carriage 300' to move together uphill across the gap 232' (FIGS. 7A–7D).

The front end of the carriage 300' has, on its underside, a recess 302'. The spring-loaded abutment 340' is formed with a bottom wedge 342'. On the uphill side of the gap 232', the end of the track section 20' is provided with a leaf spring hook 22' and a bottom wedge 24' in alignment with the recess 302' and the first wedge 342' respectively. The hook 22' lies against the underside of the track section 20' and includes a rear part 26' which is bent to protrude upwards through the body of the track section 20' and come out slightly beyond the track's upper surface.

Upon the arrival of the carriage 300' (and the car 30' transported thereon), two events will take place at the same time (FIGS. 8A–8D). First, the abutment 340' is moved downwards by reason of its wedge 342' hitting the wedge 24' of the track section 20', thereby releasing the car 30'. The car 30' will then leave the carriage 300', upon repicking up of electrical power as described above in relation to the first embodiment (or under the continual action of momentum), and then run onto the track section 20' to continue with its journey. Second, the carriage 300' is held parked against the track section 20' by reason of its recess 302' being engaged by the hook 22', thereby ensuring a successful transit for the car 30'.

While the car 30' is running onto the track section 20', one of its front wheels will roll over the rear part 26' of the spring hook 22'. As a result, the hook 22' is momentarily deflected downwards to disengage itself from the recess 302' (FIG. 9), whereby the carriage 300' is released for rolling back downhill and eventually returning to the track section 10'.

As illustrated in FIGS. 10A1, 10A2, 10B1, and 10B2, the middle track section 200' may be relocated from the aforesaid lower position to an upper position level with the adjoining track sections 10' and 20' for normal car racing.

Apart from those features as described above, the majority of the other features of the second track system 100' are generally the same as those of the first track system 100.

The provision of the gap 232/232' and associated carriages 300/300' in the track system 100/100' adds fun for playing by introducing a no-power zone (the track portion 230 or section 200') that the cars 30/30' can only cross by using respective roller coasters or slide boards (the carriages 300/300').

It is envisaged that the track portion 230 or section 200' may be made to lie at the same level as the adjoining track sections 10/10' and 20/20' (without the formation of the gap 232/232') and that each carriage 300/300' (after having been modified, for example made thinner) is arranged to slide over it for conveying the car 30/30' across the no-power zone.

The invention has been given by way of example only, and various other modifications of and/or alterations to the described embodiments may be made by persons skilled in the art without departing from the scope of the invention as specified in the appended claims.

What is claimed is:

1. A toy racing car track system comprising a plurality of track sections, including electrical power supply rails, connected end-to-end together to form at least one lane for an electric toy car to run therealong, wherein the lane includes a portion having front and rear ends and a carriage supported for moving across the portion from the front end, to convey the car from the front end to the rear end by momentum of the car, and returning to the front end upon the car leaving the carriage.

2. The toy racing car track system as claimed in claim 1, wherein the portion includes a gap having opposite sides corresponding to the front and rear ends and a bottom surface at a level relatively lower than upper surfaces of adjoining track sections.

3. The toy racing car track system as claimed in claim 2, wherein the gap is provided by a track section having front and rear platforms at opposite ends, the front and rear platforms having respective upper surfaces at the same level as, and for connection to, adjoining track sections.

4. The toy racing car track system as claimed in claim 3, wherein the front and rear platforms include electrical power supply rails.

5. The toy racing car track system as claimed in claim 4, wherein the rear platform has a part including the power supply rails and protruding into the gap, and the carriage has a front end recess for accommodating the part of the rear platform in order for a car conveyed on the carriage to regain electrical power when the carriage reaches the rear platform.

6. The toy racing car track system as claimed in claim 1, wherein the portion having front and rear ends is a gap provided by a track section having opposite ends corresponding to the front and rear ends, the track section having an upper surface at a level relatively lower than upper surfaces of the adjoining track sections.

7. The toy racing car track system as claimed in claim 6, wherein a track section adjoining the rear end of the portion providing the gap has a part including power supply rails and protruding into the gap, and the carriage has a front end recess for accommodating the part of the rear platform in order for a car conveyed on the carriage to regain electrical power when the carriage reaches the rear end of the gap.

8. The toy racing car track system as claimed in claim 1, wherein the carriage includes a retainer for retaining the car on the carriage during movement of the carriage.

9. The toy racing car track system as claimed in claim 8, wherein the retainer is movable between a first position for retaining the car and a second position for releasing the car when the carriage reaches the rear platform.

10. The toy racing car track system as claimed in claim 9, wherein the retainer has an inverted U-shaped frame having two limbs hinged to opposite sides of the carriage for pivotal movement between a lower position and an upright position corresponding to the first and second positions.

11. The toy racing car track system as claimed in claim 9, wherein the retainer is located below an upper surface of the carriage for movement between an upper position and a lower position corresponding to the first and second positions, and is spring-biased towards the upper position for retaining the car by engaging a bottom guide pin of the car.

12. The toy racing car track system as claimed in claim 9, including an abutment at the rear platform hit by the retainer when the carriage reaches the rear platform, whereby the retainer is moved from the first position to the second position.

13. The toy racing car track system as claimed in claim 9, including a resetter for moving the retainer from the second position to the first position after the car has left the carriage.

14. The toy racing car track system as claimed in claim 13, wherein the resetter is located on the carriage and is movable from a ready position to an operating position for moving the retainer to the first position.

15. The toy racing car track system as claimed in claim 14, wherein the resetter has a rear part which extends beyond the carriage when the resetter is in the ready position, for hitting the rear platform when the carriage returns there, whereby the resetter is moved to the operating position.

16. The toy racing car track system as claimed in claim 1, wherein the portion is inclined at a small angle upwards with its rear end relatively higher than its front end for the carriage to return to the front end by gravitational force.

* * * * *